US009964317B2

(12) United States Patent
Chang

(10) Patent No.: US 9,964,317 B2
(45) Date of Patent: May 8, 2018

(54) PORTABLE DC AIR-CONDITIONER HAVING A ROTATABLE AIR OUTLET STRUCTURE RELATIVE TO THE REFRIGERATION HOUSING

(71) Applicant: Ching-Ko Chang, Tainan (TW)

(72) Inventor: Ching-Ko Chang, Tainan (TW)

( * ) Notice: Subject to any disclaimer, the term of this patent is extended or adjusted under 35 U.S.C. 154(b) by 331 days.

(21) Appl. No.: 14/728,130

(22) Filed: Jun. 2, 2015

(65) Prior Publication Data

US 2015/0354835 A1 Dec. 10, 2015

(30) Foreign Application Priority Data

Jun. 4, 2014 (TW) ..... 103119312 A

(51) Int. Cl.
*F25D 23/12* (2006.01)
*F24F 1/02* (2011.01)
*F24F 1/04* (2011.01)

(52) U.S. Cl.
CPC ..... *F24F 1/025* (2013.01); *F24F 1/04* (2013.01)

(58) Field of Classification Search
CPC ..... F24F 1/025; F24F 1/04
USPC ..... 62/259.1
See application file for complete search history.

(56) References Cited

U.S. PATENT DOCUMENTS 6,192,702 B1 * 2/2001 Shimogori ..... F24F 1/04 62/259.3
7,231,777 B1 * 6/2007 Arnold ..... F24F 1/025 62/259.3
7,886,548 B1 * 2/2011 Graves ..... B62B 9/00 62/272
7,895,849 B2 * 3/2011 Chiu ..... F24F 1/025 137/398
7,997,565 B1 * 8/2011 Chan ..... F24F 6/043 261/107
8,113,490 B2 * 2/2012 Chen ..... A61M 11/005 261/81
2005/0034476 A1 * 2/2005 Pohr ..... A41D 13/0055 62/420
2008/0016905 A1 * 1/2008 Yi ..... F24F 1/025 62/498
2008/0078196 A1 * 4/2008 Chen ..... F24F 1/025 62/239
2009/0118869 A1 * 5/2009 Cauchy ..... A01K 1/0245 700/276

(Continued)

*Primary Examiner* — David Teitelbaum
*Assistant Examiner* — Filip Zec
(74) *Attorney, Agent, or Firm* — Rosenberg, Klein & Lee

(57) ABSTRACT

A portable DC air-conditioner has a cooler circulation system inside a housing, including a DC compressor, a condenser, an expansion valve and an evaporator. The evaporator is disposed inside an air duct which has an end thereof connected to a fan and another end thereof forming a discharging exit. The condenser is arranged below the evaporator and the air duct has a guiding tube at the bottom thereof so that the water drops made by the evaporator would be guided to flow into the condenser. A distributing portion is disposed on the housing, including a base connected to the discharging exit and at least one hollow frame having a circular slit on the inner edge for cooled air to be discharged. The evaporator in the air duct would produce cooled air and transport the cooled air to the discharging exit to flow out from the circular slit, forming a cooler circulation system with small volume and great efficiency.

8 Claims, 9 Drawing Sheets

(56) References Cited

U.S. PATENT DOCUMENTS

| | | | | |
|---|---|---|---|---|
| 2009/0124192 | A1* | 5/2009 | Ku | F24F 1/025 454/367 |
| 2010/0050682 | A1* | 3/2010 | Ariga | F24F 3/14 62/401 |
| 2011/0146943 | A1* | 6/2011 | Branning | F24F 1/025 165/47 |
| 2011/0262114 | A1* | 10/2011 | Montgomery | F24F 1/025 392/365 |
| 2012/0090344 | A1* | 4/2012 | Cho | E06B 7/03 62/262 |
| 2013/0047662 | A1* | 2/2013 | Black | F24F 1/025 62/498 |
| 2015/0267929 | A1* | 9/2015 | Kim | F24F 5/001 62/89 |

* cited by examiner

PORTABLE DC AIR-CONDITIONER HAVING A ROTATABLE AIR OUTLET STRUCTURE RELATIVE TO THE REFRIGERATION HOUSING

BACKGROUND OF THE INVENTION

1. Field of the Invention

The present invention relates to a portable DC air-conditioner, particularly to one that can be moved indoors and carried outdoors.

2. Description of the Related Art

Conventional air-conditioners usually have a reciprocating compressor or one with rolling piston to operate with refrigerant. Such compressors have large volume and would distribute heat; therefore they are more suitable to be installed outdoors instead of indoors or small space.

In our daily life, many of the indoor spaces may not be able to install air-conditioners due to lack of window for installment or need of long duct to be connected for split-type air-conditioners, causing inconveniences and making it unsuitable for installment. Also, conventional air-conditioners are mostly stationary; therefore, a house would have multiple air-conditioners for each installed in one room. This would be a waste of the machines and other minor resources for installment when the rooms are not always fully occupied.

On the other hand, when people go out for outdoor activities like travelling and camping, one of the major problems is the heat. Conventional air-conditioners use AC compressors for operation and therefore have large volume; also they require main supply (AC power supply) to operate, making it impossible to be portable as certain types of fans.

Therefore, the inventor has tried hard to find a solution for the problems mentioned above and make improvements.

SUMMARY OF THE INVENTION

A primary object of the present invention is to provide a portable DC air-conditioner that can be moved indoors with low noises and would not distribute heat with high temperature.

Another object of the present invention is to provide a portable DC air-conditioner that has a small volume with great cooling efficiency and can be carried outdoors for outdoor usage.

Yet another object of the present invention is to provide a portable DC air-conditioner that can distribute cooled air without the structure of running blades has the distributing portion thereof being able to rotate in every angle, to adjust the angle of elevation, and to distribute cooled air in eddy currents so as to achieve greater cooling efficiency.

To achieve the objects mentioned above, the present invention comprises a housing having a placing space therein and a display panel arranged on the outside; a cooler circulation system disposed in the placing space, including: a DC compressor to compress gaseous refrigerant with low pressure into one with high pressure and high temperature, having an inlet for gaseous refrigerant to enter and an outlet to be discharged; a condenser having an intake tube, an outlet tube, and a mechanical fan arranged above where the intake tube being connected to the outlet of the DC compressor; an expansion valve having an input end and an output end for transportation of refrigerant where the input end being connected to the outlet tube of the condenser; an evaporator having an entry connected to the output end of the expansion valve and an exit connected to the inlet of the DC compressor; wherein the evaporator is disposed in an air duct having an outlet opening connecting an exit opening of a fan with the fan having a suction part connected to the surface of the housing to suck in the air from outside, a discharging exit arranged on the other side of the outlet opening for discharging cooled air, and a guiding tube arranged at the bottom thereof for guiding the water drops made by the evaporator to flow out; the condenser is arranged below the evaporator and has a drip tray at the bottom thereof; the housing has a circular opening corresponding to the discharging exit of the air duct for cooled air to exit; and a distributing portion including a base and at least one hollow frame arranged on the base; the base having a connecting portion at the bottom thereof corresponding to the circular opening for discharging cooled air, and the inner edge of the hollow frame having a circular slit linking to at least either side of the outer edge so that the cooled air would flow through the hollow frame and flow out from the circular slit; whereby the cooled air produced by the cooler circular system inside the housing would flow to the distributing portion via the discharging exit of the air duct, and then flow out from the circular slit around the hollow frame.

Based on the structure disclosed above, the evaporator is arranged in a U shape and the air duct is arranged in accordance with the shape of the evaporator. The base of the distributing portion is arranged in a U shape for a pair of engaging elements arranged at both sides of the hollow frame to be engaged in the middle so that the cooled air is able to flow into the hollow frame for discharging. The circular opening of the housing further has a rotating element disposed therein with a driven surface contacting with a driving element fixed by a positioning element and driven by a small motor arranged below, so as to rotate the rotating element; the connecting portion under the bottom of the base is arranged correspondingly to the rotating element and can be engaged therein for the distributing portion to rotate in operation.

Furthermore, the mechanical fan is arranged above the condenser. The guiding tube has the water drops in the air duct to flow out above the mechanical fan. The circular slit around the hollow frame has a plurality of inclined ribs arranged thereon so that the cooled air would be discharged in eddy currents; the present invention may include two or more than two hollow frames arranged on the base.

With structures disclosed above, the evaporator in the air duct of the present invention would produce cooled air and efficiently transport the cooled air to the distributing portion to flow out from the circular slit without the structure of running blades, forming a cooler circulation system with small volume and great cooling efficiency. Also, the water drops made by the evaporator can cool down the condenser and help with heat dissipation, preventing the entire device from reaching high temperature during operation. Therefore, the present invention is suitable for both indoors and outdoors.

DETAILED DESCRIPTION OF THE PREFERRED EMBODIMENT

Figure 1:
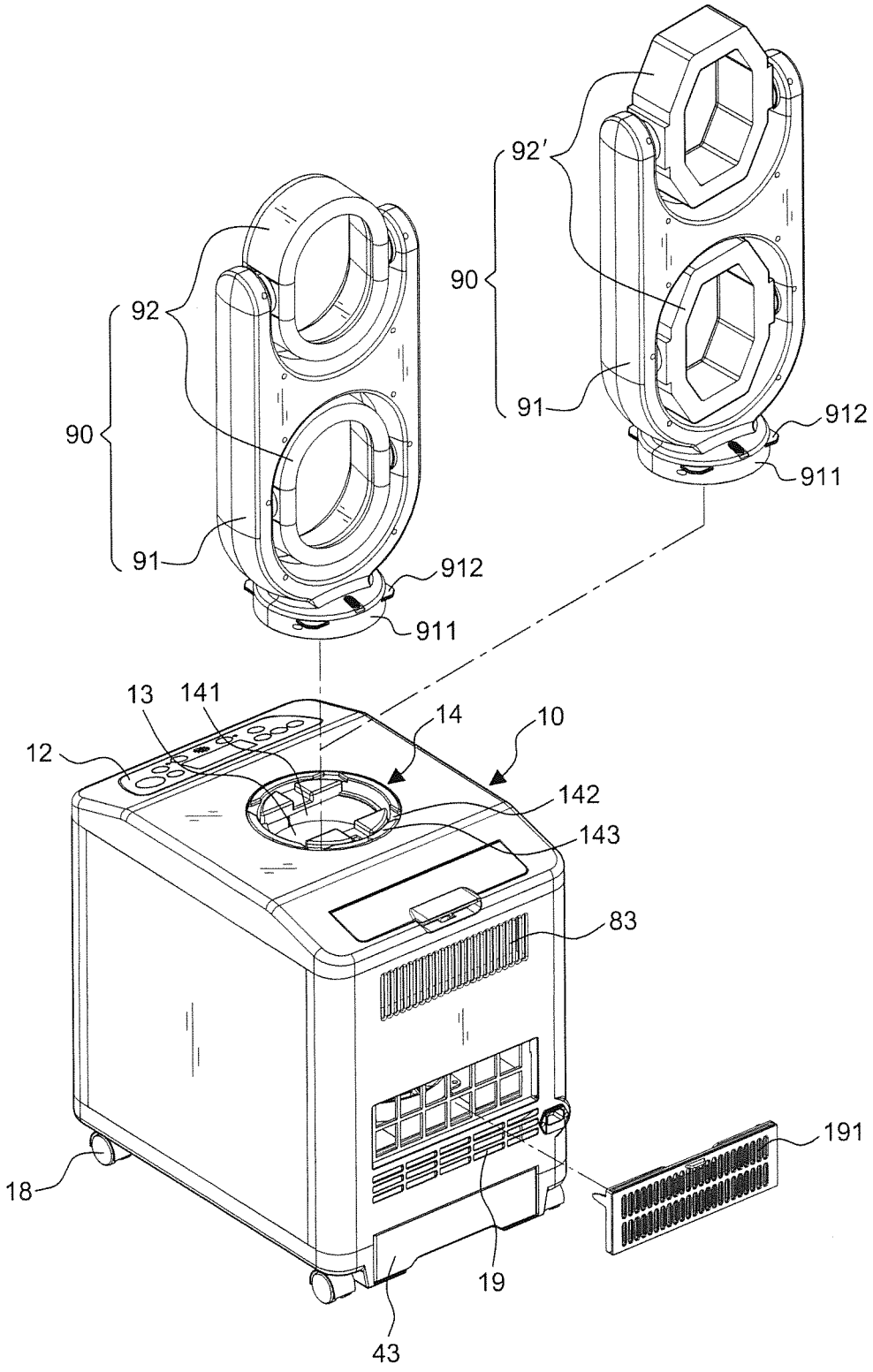
FIG. 1 is an exploded view of the present invention in a preferred embodiment.
Figure 2:
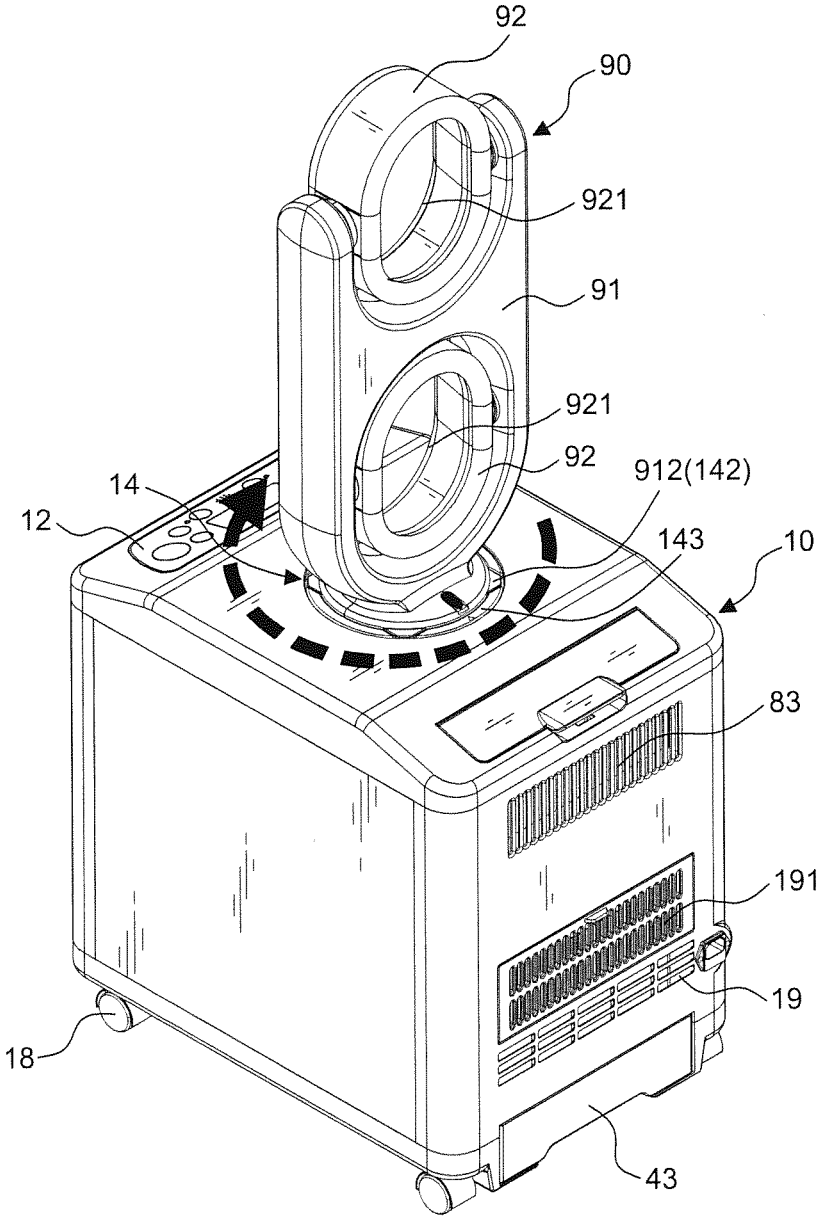
FIG. 2 is a perspective view of the present invention in a preferred embodiment.
Figure 3:
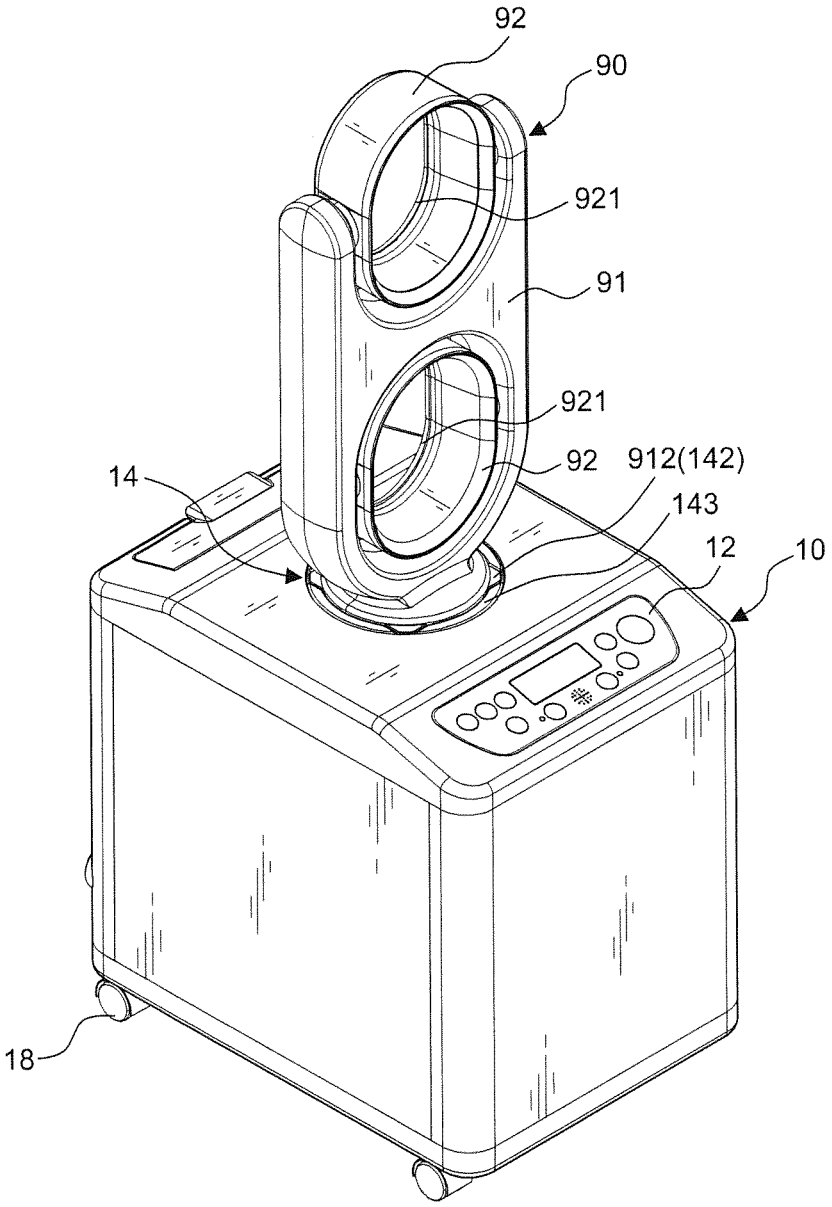
FIG. 3 is a perspective view of the present invention in another preferred embodiment.

Referring to FIGS. 1-7, a preferred embodiment of the present invention mainly comprises a housing 10, a cooler circulation system 20, and a distributing portion 90.

The housing 10 has a placing space 11 therein and a display panel 12 arranged on the outside, and the bottom thereof may have a plurality of castor wheel 18 but the present invention is not limited to such application.

The cooler circulation system 20 is disposed in the placing space 11, including a DC compressor 20, a condenser 40, an expansion valve 50, and an evaporator 60.

The DC compressor 20 compresses gaseous refrigerant with low pressure into one with high compression and high temperature, and has an inlet 31 for gaseous refrigerant to enter and an outlet 32 to be discharged. The condenser 40 has an intake tube 41, an outlet tube 42, and a mechanical fan 44 arranged above; the intake tube 41 is connected to the outlet 32 of the DC compressor 20. The expansion valve 50 has an input end 51 and an output end 52 for transportation of refrigerant; the input end 51 is connected to the outlet tube 42 of the condenser 40. The evaporator 60 has an entry 61 connected to the output end 52 of the expansion valve 50 and an exit 62 connected to the inlet 31 of the DC compressor 30. Such structure of the condenser 40 belongs to prior art.

Figure 4:
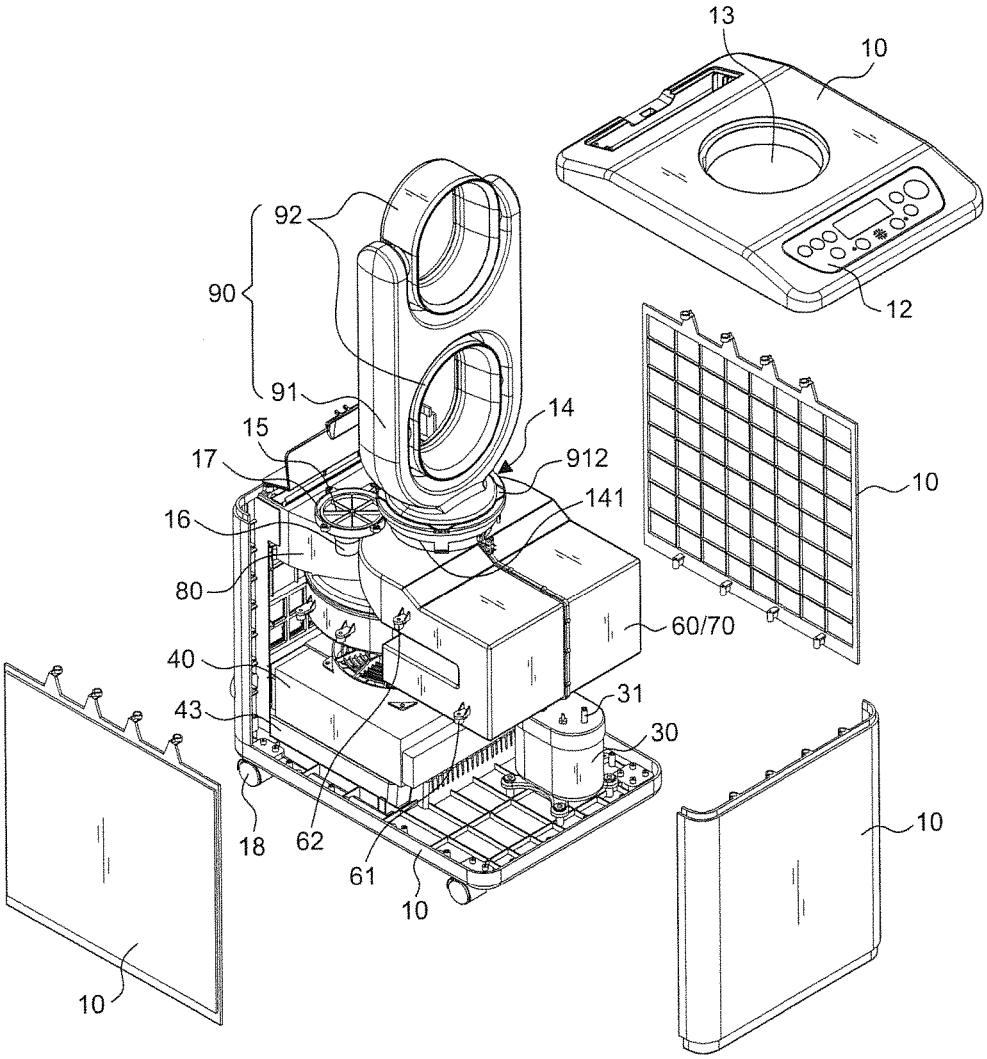
FIG. 4 is a perspective view of the structure inside the housing of the present invention in a preferred embodiment.
Figure 4A:
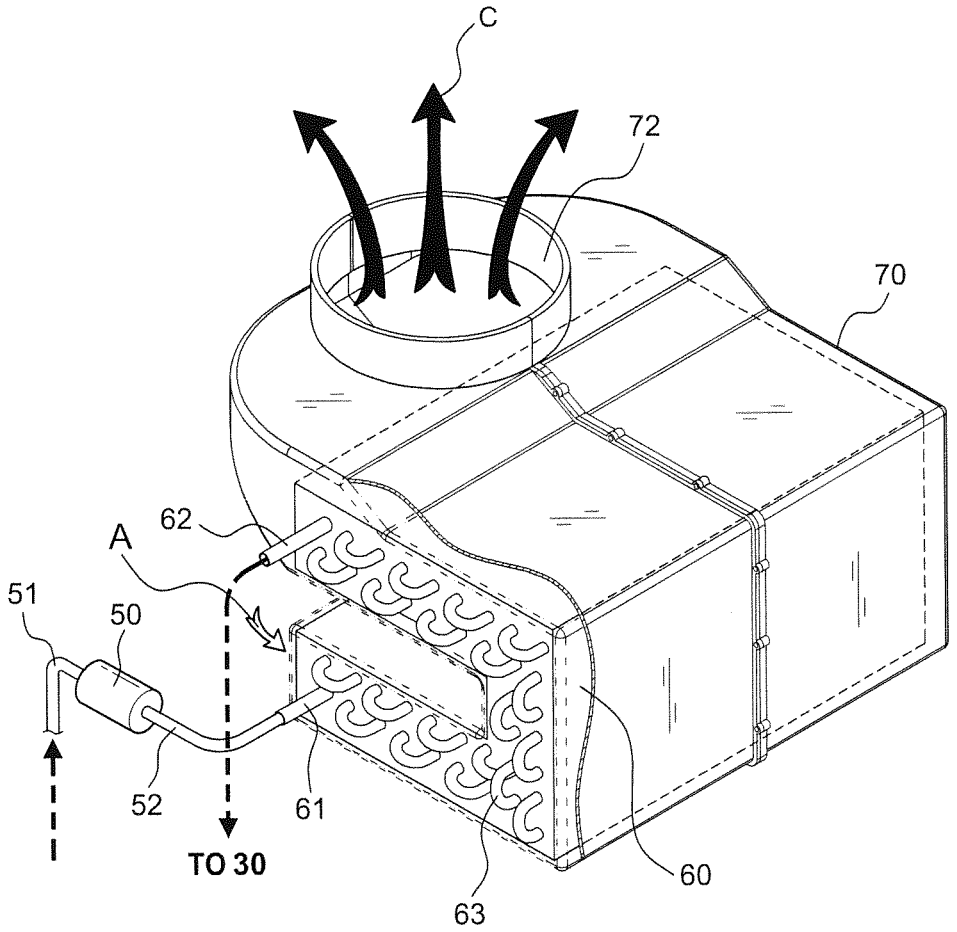
FIG. 4A is a perspective view of the air duct and evaporator of the present invention in a preferred embodiment.

The features of the invention lies in that the evaporator 60 is disposed in an air duct 70 having an outlet opening 71 connecting an exit opening 81 of a fan 80 as shown in FIG. 4A; the fan 80 has a suction part 82 connected to the surface of the housing 10 to suck in the air A from outside. The suction part 82 further has a filtering unit 83 arranged therein, and the filtering unit 83 can be made of a filter, activated carbon, or Nano photocatalysts. In addition, the air duct 70 has a discharging exit 72 arranged on the other side of the outlet opening 71 for discharging cooled air C, and at least one guiding tube 74 arranged at the bottom thereof for guiding the water drops L made by the evaporator 60 to flow out to a mechanical fan 44 above the condenser 40. The mechanical fan 44 has a propeller blade 441 and a motor 442 to actuate the propeller blade 441. In this embodiment, the centrifugal force created by the propeller blade 41 would swing the water drops L to the condenser 40 as water mists to cool down the temperature of the condenser 40 and help with heat dissipation. Such structure is different from the air-conditioner in the prior art. The conventional air-conditioner in the prior art has a fan to draw out the heat from the condenser therein; on the other hand, the present invention has the structure of mechanical fan 44 being disposed above the condenser 40, which is more suitable for indoor application for that the device would not emit heat and affect the cooling efficiency. Besides, the water mists spread onto the condenser 40 would exchange heat with the refrigerant and therefore turning the heat into airflow with normal atmospheric temperature to flow out via a circulation hole 19 and then to be taken back into the device by the mechanical fan 44, so as to achieve indoor application.

Referring to FIG. 4A, in this embodiment, the evaporator 60 is arranged in a U shape and the air duct 70 is arranged in accordance with the shape of the evaporator 60 so that the present invention can produce enough cooled air C within the limited space Also, the fan 80 includes a casing 84, a plurality of rotating blades 85, and a motor 86.

Figure 6:
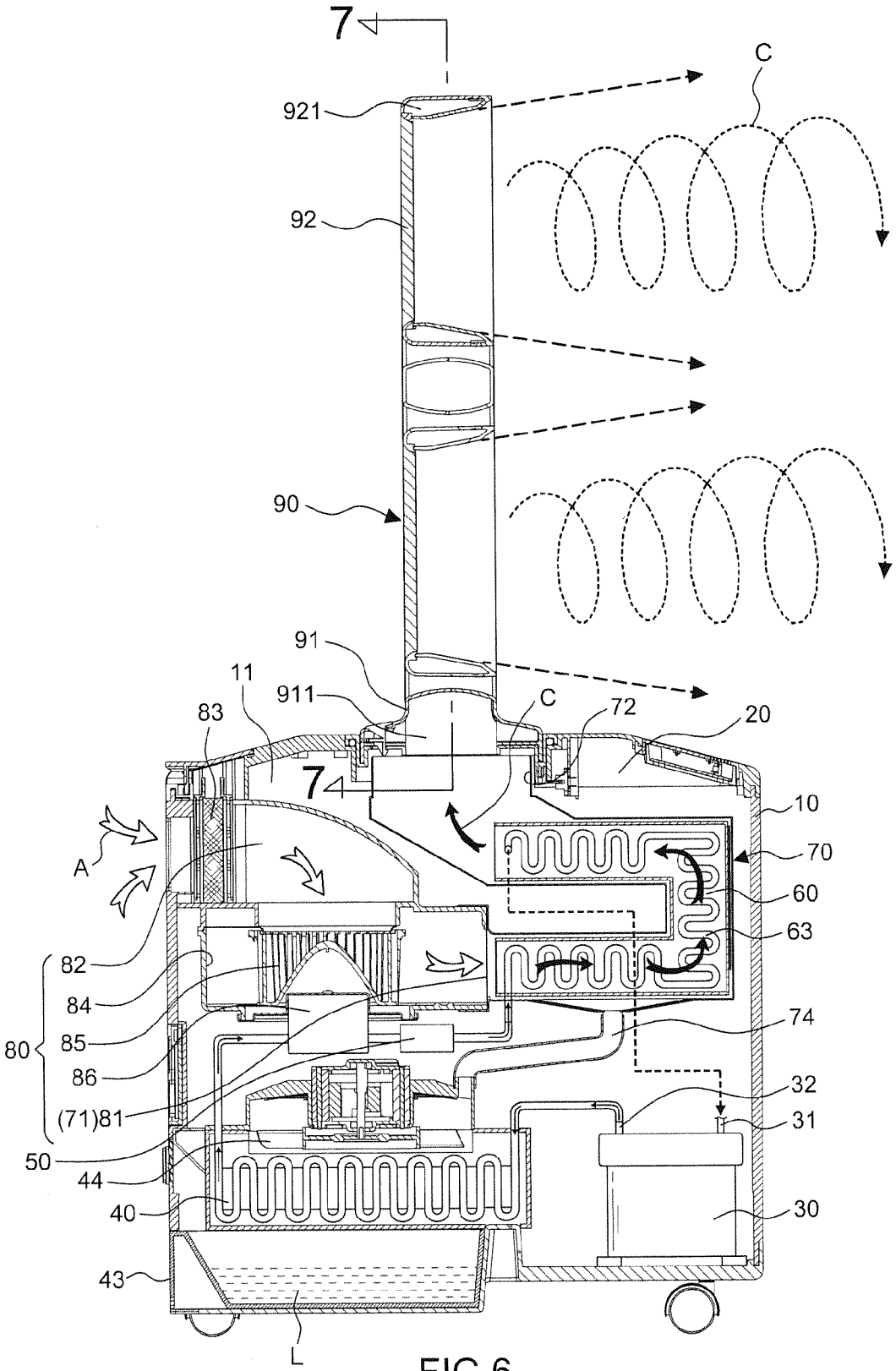
FIG. 6 is a sectional view of the present invention in a preferred embodiment.

Furthermore, the condenser 40 is arranged below the evaporator 60 for the water drops L made by the evaporator 60 to be flow into the condenser 40 via the guiding tube 74 to cool down the condenser 40 and help with heat dissipation; and those without being evaporated by the condenser 40 would fall onto a drip tray 43 disposed at the bottom of the condenser 40 as illustrated in FIG. 6.

Figure 7:
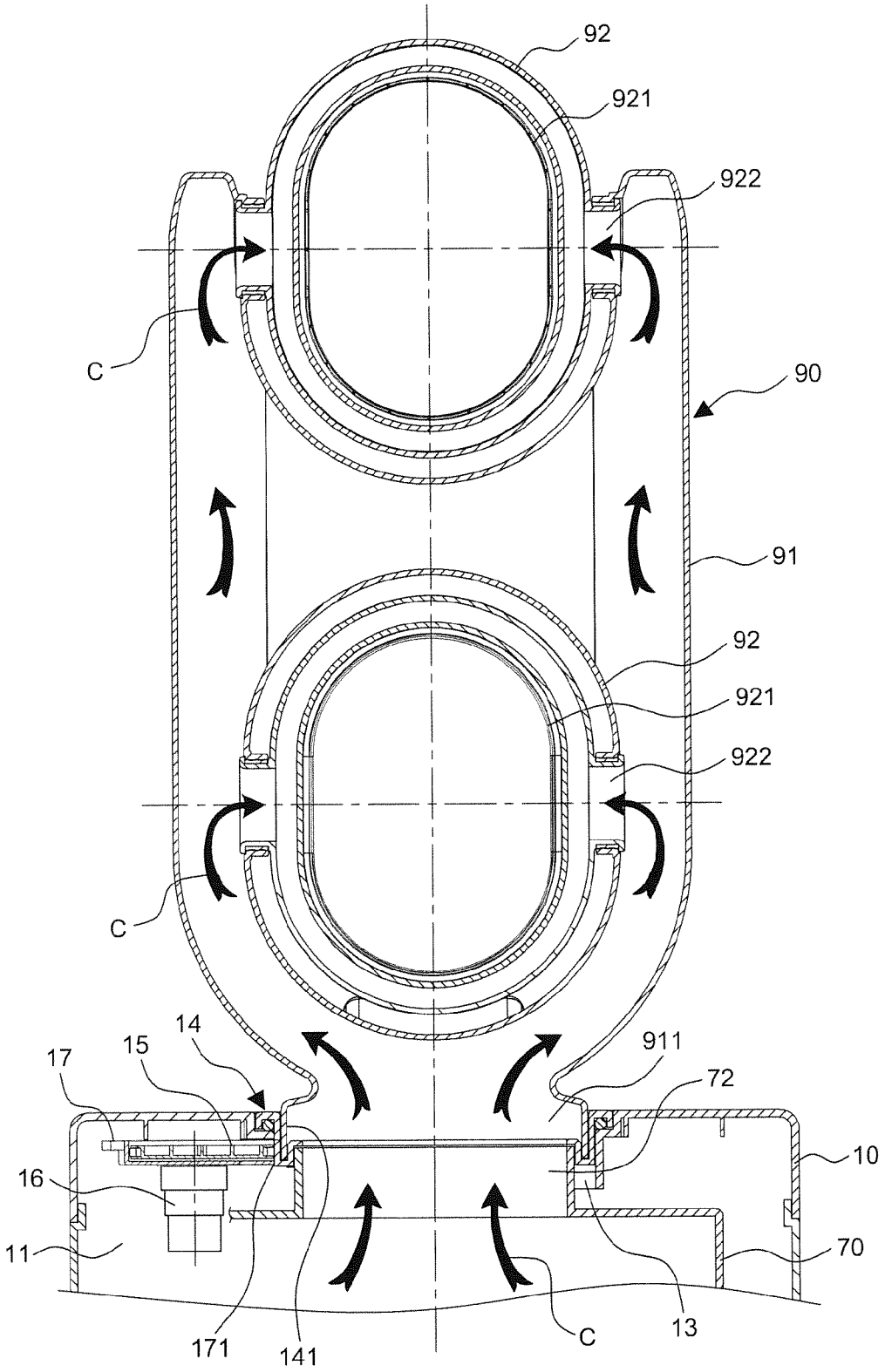
FIG. 7 is a sectional view along line 7-7 in FIG. 6.

The distributing portion 90 includes a base 91 and at least one hollow frame 92 arranged on the base 91. As shown in FIG. 7, the hollow frame 92 can be one, two, or more than two; referring to FIG. 1, it can be an elliptical or polygonal shape. In this embodiment, the present invention has two elliptical shaped hollow frames 92, each of them can individually adjust different distributing angle during operation. The base 91 has a connecting portion 911 at the bottom thereof corresponding to the circular opening 13 for discharging cooled air C, and the inner edge of each hollow frame 92 has a circular slit 921 linking to at least either side of the outer edge so that the cooled air C would flow through the hollow frames 92 and flow out from the circular slits 921; the base 91 of the distributing portion 90 is arranged in a U shape for a pair of engaging elements 922 arranged at both sides of the hollow frames 92 to be engaged in the middle so that the cooled air C is able to flow into the hollow frames 92 for discharging.

Figure 8:
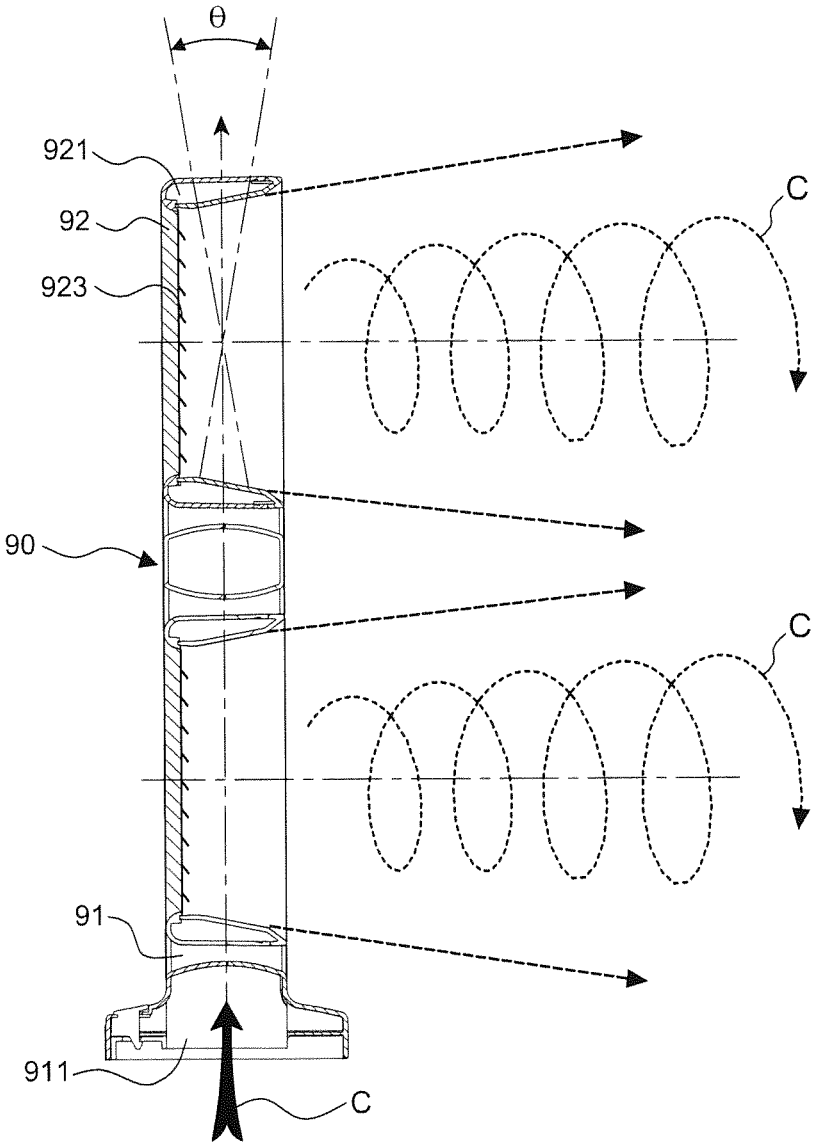
FIG. 8 is a schematic diagram illustrating the operation of the distributing portion.

Whereby the cooled air C produced by the cooler circular system 20 inside the housing 10 would flow to the distributing portion 90 via the discharging exit 72 of the air duct 70, and then flow out from the circular slits 921 around the hollow frames 92. FIG. 8 illustrates the hollow frames 92 adjusting the distributing angle θ by the engaging elements 922.

In this embodiment, the DC compressor 30 includes a sealed DC compressor 30 which only has the inlet 31 and outlet 32 thereof extending to the outside, so as to lower the noises during operation for the occasion of indoor application. Currently a DC compressor in the market has a length within 12 cm; the cooling capacity is 2.0 cc, and the rotating speed is more than 2000 RPM but less than 6500 RPM, which has a result of 460 watts/1567 Btuh output. Such DC compressor with the evaporator 60 being arranged within the air duct 70 allows the housing 10 of the present invention to have a small volume with height and length between 30-50 cm, achieving a small volume with great cooling efficiency. Moreover, since the DC compressor 30 is able to operate with 12V DC input, it can also obtain electricity from a battery or the cigarette lighter on the cars, achieving its portable convenience. As for indoor applications, it can easily obtain electricity by an AC-DC converter on a plug.

Figure 5:
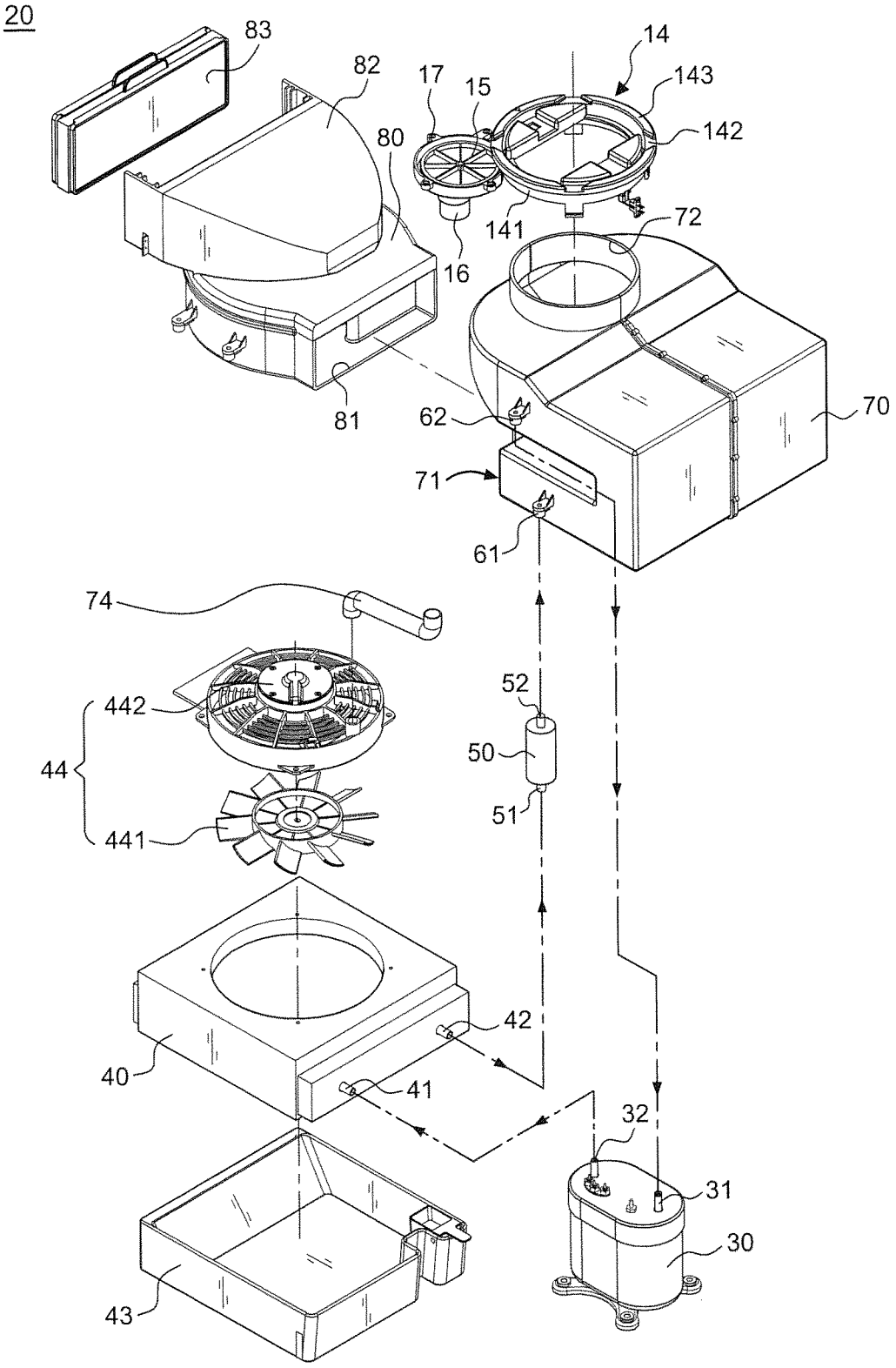
FIG. 5 is an exploded view of a cooler circulation system of the present invention in a preferred embodiment.

Referring to FIGS. 4, 5, and 7, in this embodiment, the circular opening 13 of the housing 10 has a rotating element 14 disposed therein with a driven surface 141 contacting with a driving element 15. The driven surface 141 is made of rubber and has an inner surface 143 including a plurality of recessed slots 142 thereon. The driving element 15 is fixed by a positioning element 17 and driven by a small motor 16 arranged below; the positioning element 17 has a gap 171 for the driving element 15 to contact with the driven surface 141 of the rotating element 14, so as to rotate the rotating element 14 when the small motor 16 is actuated. The connecting portion 911 under the bottom of the base 10 and has a plurality of engaging blocks 912 engaged correspondingly to the recessed slots 142 of the rotating element 14, so that the base 10 is engaged the rotating element 14 and that the distributing portion 90 is able to rotate in every angle during operation. Since the rotating element 14 is actuated by rubbing against the driven surface 141, if the distributing portion 90 is restrained by other forces and stops the rotation, the contacting driving element 15 and driven surface 141 would slide back and forth, protecting the device from malfunctioning or damages.

Further referring to FIG. 8, each circular slit 921 around the hollow frames 92 has a plurality of inclined ribs 923 arranged thereon so that the cooled air C would be discharged in eddy currents, thus enlarging the blowing area. Additionally, the present invention sends out cooled air C without the structure of running blades so that the distributing portion 90 would rotate in every angle and adjusts the angle of elevation θ, so as to achieve greater cooling efficiency.

As stated above, the present invention can effectively transport cooled air C from the evaporator 60 in the air duct 70 to the distributing portion 90 and send out from the circular slits 921 without the structure of running blades, achieving great cooling efficiency within a small volume; also, the water drops L made by the evaporator 60 would cool down the condenser 40 and help with heat dissipation, ensuring the temperature of the housing 10 would not rise and making it suitable for both indoor and outdoor application.

In this embodiment, the cooler circulation system 20 of the present invention sends out cooled air C; it can also alter the circulation process to send out warm air as a heater, or function as a dehumidifier. Such application has already been disclosed in the prior art.

Although particular embodiment of the invention has been described in detail for purposes of illustration, various modifications and enhancements may be made without departing from the spirit and scope of the invention. Accordingly, the invention is not to be limited except by the appended claims.

What is claimed is:

1. A portable DC air-conditioner, comprising:

a housing having a placing space therein and a display panel arranged on an outside surface of the housing;

a cooler circulation system disposed in the placing space, including:

a DC compressor to compress gaseous refrigerant with low pressure into a refrigerant having high pressure and high temperature, having an inlet for gaseous refrigerant to enter and an outlet to be discharged;

a condenser having an intake tube, an outlet tube, and a mechanical fan arranged above where the intake tube being connected to the outlet of the DC compressor;

an expansion valve having an input end and an output end for transportation of refrigerant where the input end being connected to the outlet tube of the condenser;

an evaporator having an entry connected to the output end of the expansion valve and an exit connected to the inlet of the DC compressor;

wherein the evaporator is disposed in an air duct having an outlet opening connecting an exit opening of a fan with the fan having a suction part connected to a surface of the housing to suck in the air from outside, a discharging exit arranged on an opposing side of the air duct from the outlet opening for discharging cooled air, and a guiding tube arranged at a bottom of the air duct for guiding water drops made by the evaporator to flow out; the condenser is arranged below the evaporator and has a drip tray disposed at a bottom of the condenser; the housing has a circular opening corresponding to the discharging exit of the air duct for cooled air to exit; and a distributing portion including a base and at least one hollow frame arranged on the base; the base having a connecting portion at a bottom of the base corresponding to the circular opening for discharging cooled air, and an inner edge of the hollow frame having a circular slit linking to at least either side of the outer edge so that the cooled air flows through the hollow frame and flow out from the circular slit;

whereby the cooled air produced by the cooler circulation system inside the housing flows to the distributing portion via the discharging exit of the air duct, and then flow out from the circular slit around the hollow frame.

2. The portable DC air-conditioner as claimed in claim 1, wherein the evaporator is arranged in a U shape and the air duct is arranged in accordance with the shape of the evaporator.

3. The portable DC air-conditioner as claimed in claim 1, wherein the base of the distributing portion is arranged in a U shape for a pair of engaging elements arranged at both sides of the hollow frame to be engaged in the middle so that the cooled air is able to flow into the hollow frame for discharging.

4. The portable DC air-conditioner as claimed in claim 1, wherein the circular opening of the housing further has a rotating element disposed therein with a driven surface contacting with a driving element fixed by a positioning element and driven by a small motor arranged below, so as to rotate the rotating element; the connecting portion under the bottom of the base is arranged correspondingly to the rotating element and can be engaged therein for the distributing portion to rotate during operation.

5. The portable DC air-conditioner as claimed in claim 1, wherein the mechanical fan is arranged above the condenser.

6. The portable DC air-conditioner as claimed in claim 5, wherein the guiding tube has the water drops in the air duct to flow out above the mechanical fan.

7. The portable DC air-conditioner as claimed in claim 1, wherein the circular slit around the hollow frame has a plurality of inclined ribs arranged thereon so that the cooled air would be discharged in eddy currents.

8. The portable DC air-conditioner as claimed in claim 1, wherein the present invention can include two or more than two hollow frames arranged on the base.

* * * * *